US005125850A

United States Patent [19]

Locati

[11] Patent Number: 5,125,850

[45] Date of Patent: Jun. 30, 1992

[54] STRAIN RELIEF FOR AN ELECTRICAL CONNECTOR

[75] Inventor: Ronald P. Locati, Harrisburg, Pa.

[73] Assignee: AMP Incorporated, Harrisburg, Pa.

[21] Appl. No.: 799,239

[22] Filed: Nov. 27, 1991

[51] Int. Cl.[5] ..... H01R 13/58; H01R 4/24

[52] U.S. Cl. ..... 439/404; 439/417

[58] Field of Search ..... 439/404, 405, 417, 456, 439/459, 470

[56] References Cited

U.S. PATENT DOCUMENTS

| | | | |
|---|---|---|---|
| 4,111,512 | 9/1978 | Parmer et al. | 439/404 |
| 4,359,257 | 11/1982 | Lopinski et al. | 439/405 |
| 4,538,873 | 9/1985 | Worth | 439/404 |
| 4,693,533 | 9/1987 | Szczesny et al. | 439/404 |
| 4,781,615 | 11/1988 | Davis et al. | 439/395 |
| 4,891,019 | 1/1990 | Olsson | 439/404 |
| 4,897,041 | 1/1990 | Heiney et al. | 439/404 |
| 4,925,401 | 5/1990 | Fogg et al. | 439/404 |
| 4,960,390 | 10/1990 | Davis et al. | 439/404 |

*Primary Examiner*—Gary F. Paumen
*Attorney, Agent, or Firm*—David L. Smith

[57] ABSTRACT

A connector housing (12) for terminating a multi-conductor cable (108) is disclosed. In the preferred embodiment, the connector housing (12) comprises a cable receiving face (20), an opposed, parallel mating face (22), and perpendicularly opposed endwalls (24,26), with two rows of conductor terminating contacts (e.g., 32) on the cable receiving face (20) extending between said endwalls (24,26). Each endwall (24,26) has a connector tower (28,30) with outwardly protruding detents (e.g., 36,38). A termination cover (14) is disclosed which has a fluted bottom portion (60) and a smooth top surface (62). The crossmember (58) is flanked on each side by downwardly extending U-shaped guide slots (e.g., 66). A strain relief member (16) is also disclosed which has a crossmember (74) flanked on each side by downwardly extending endwalls (76,78) which are divided at the bottom to form two pairs of latch arms (80,81 and 82,83) which contain outwardly protruding detents (e.g., 84,86). In operation, the termination cover (14) is pressed onto the connector housing (12) terminating the cable (108) therebetween. Then, the strain relief member (16) is pressed toward the termination cover (14) and connector housing (12) unit. As the strain relief member (16) moves closer, each pair of latch arms (80,81 and 82,83) bends toward the other pair; and the strain relief member's crossmember (74) slightly bows simultaneously. Continued movement causes the towers (28,30) to flex outwardly. Finally, the towers (28,30) and the latch arms (80,81,82,83) resile, thereby latching the strain relief member (16) to the connector housing (12).

16 Claims, 9 Drawing Sheets

78
16
83
82
106
104
10
63
69
71
63
69
65
74
90
76
80
81
94
84
102
88
92
86
103
100
98
96
62
58
70
66
54
55
46
38
44
30
52
59
60
14
69
63
65
69
71
68
64
32
33
34
20
72
55
50
56
36
42
40
57
48
26
12
18
28
22
24

STRAIN RELIEF FOR AN ELECTRICAL CONNECTOR

BACKGROUND OF THE INVENTION

The present invention relates to electrical connectors and, in particular, to strain relief devices for use with multiple conductor flat cable connectors.

There are various strain relief devices for use with multiple conductor flat cable connectors.

For example, U.S. Pat. No. 4,111,512 provides a cover and a strain relief which form an integral portion of a multi-conductor flat cable connector.

Typically, when a strain relief member is attached to a connector housing, the strain relief member is positioned on the outside of the connector housing. See U.S. Pat. No. 4,897,041. Because the strain relief member is not within the connector housing profile, it is easily dislodged.

Further, the prior art discloses strain relief members, termination covers, and connector housings, wherein there are virtually no moving parts or only the strain relief member has moving parts. See U.S. Pat. No. 4,359,257.; and U.S. Pat. No. 4,897,041.

Finally, the prior art discloses strain relief members which are rendered useless if one latch arm or one pair of latch arms fails. That is, should the strain relief member become broken in half during termination or post-termination, the strain relief member will either drop from the connector and termination cover, or it will become virtually useless in its ability to provide actual strain relief. See U.S. Pat. No. 4,897,041.

Accordingly, it is the primary object of this invention to provide a strain relief member which remains within the profiles of both the connector housing and the termination cover.

It is a further object to provide a strain relief member and a connector housing, both of which utilize moving parts.

It is yet another object to provide a strain relief member with multiple pairs of latch arms, wherein each pair can work independently of the other, such that the strain relief member will not fall from the termination cover and connector housing if one latch arm fails.

The above and other objects and advantages of this invention will become more readily apparent when the following description is read in conjunction with the accompanying drawings.

SUMMARY OF THE INVENTION

To overcome the deficiencies of the prior art and to achieve the objects and advantages listed above, Applicant discloses an invention which, in its preferred embodiment, comprises a connector housing, a termination cover, and a strain relief member.

The connector housing includes a cable receiving face, an opposed mating face, and a plurality of contact receiving passages extending therebetween. The cable receiving face is flanked on both ends by upstanding, opposed, parallel towers. The cable receiving face has two rows of contacts, extending upwardly between the towers. Each contact is further comprised of individual insulation displacement plates.

The termination cover has an upper crossmember portion and a fluted lower crossmember portion. Each endwall of the crossmember portion is flanked by a descending, opposed, parallel U-shaped guide slot.

The strain relief member is comprised of upper and lower crossmember portions. Extending downwardly from the crossmember portions are two opposed, parallel endwalls. Each endwall is further divided into two latch arms. Each latch arm has an outwardly and upwardly extending protrusion or detent. In the preferred embodiment, the strain relief member is designed so as to fit within the profiles of the connector housing and the termination cover.

In operation, the termination cover is secured to the connector housing, in a pretermination position. A cable, the conductors of which are to be terminated to respective contacts in the connector, is inserted between the termination cover and the connector housing. The termination cover is then pressed toward the connector housing thereby terminating the conductor cable that has been inserted therebetween. The cable is then wrapped back on top of the termination cover. Subsequently, the strain relief member is fastened to the connector housing towers with the latch arms extending through the termination cover.

To attach the strain relief member, its latch arms are inserted between guide slots on the termination cover and the connector housing towers. When the latch arms come in contact with the connector towers, the cross member of the termination cover bows slightly in the middle. In addition, the latch arms bend inwardly toward each other as they engage portions of the connector towers which bend outwardly. As the strain relief member continues to move toward the termination cover and connector housing, the inner surfaces of the latch arms engage a surface of the termination cover. Continued movement of the strain relief member causes the towers to flex outwardly. The strain relief member moves toward the termination cover and connector housing until latching surfaces on the detents of the latch arms pass cooperating latching surfaces on the towers. When these cooperating latching surfaces pass, the towers on the connector housing and the latch arms on the strain relief member at least resiles. Thus, the strain relief member latches to the connector housing.

BRIEF DESCRIPTION OF THE DRAWING

FIGS. 7–9 are side views of the invention in an assembly sequence, in which FIG. 7 shows the termination cover as it engages portions of connector housing towers (ribbon cable has been omitted for clarity);

FIG. 8 shows the strain relief member as it moves further towards the termination cover from its initial position shown in FIG. 7; and FIG. 9 shows the strain relief member latched to the connector housing.

DESCRIPTION OF THE PREFERRED EMBODIMENT

Figure 1:
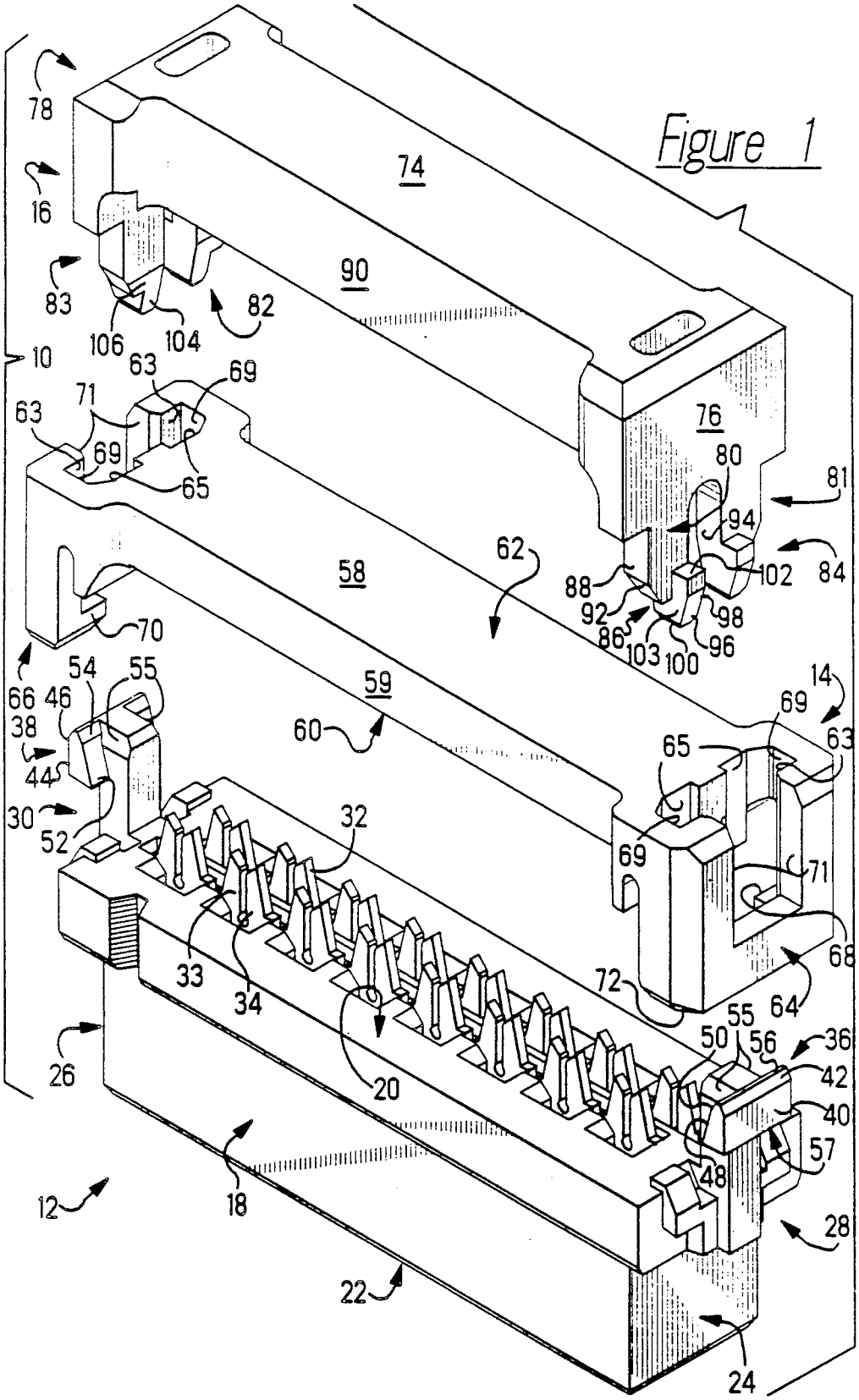
FIG. 1 is an exploded perspective view of a connector housing, a termination cover and a strain relief member positioned to be assembled, constructed in accordance with the present invention.
Figure 2:
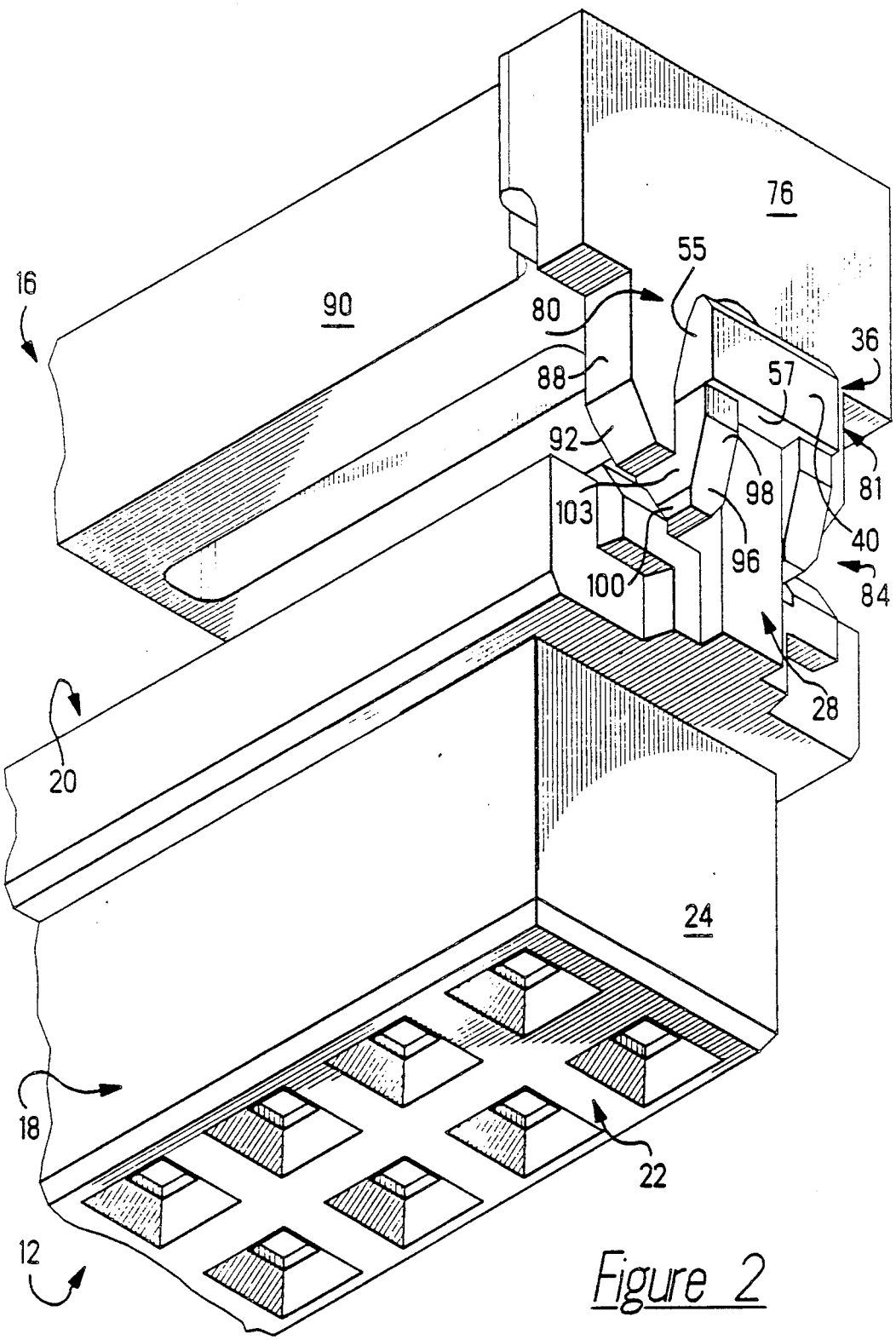
FIG. 2 is a partial perspective end view of the connector housing with the strain relief member secured thereto.

Referring to the drawings in detail, the preferred embodiment of an electrical connector assembly is shown and generally designated by numeral 10. The assembly 10 comprises a connector housing 12, a termination cover 14 for terminating a cable to the connector housing 12, and a strain relief member 16 which aids in maintaining the cable in its terminated position.

Before any structure is defined, it should be noted that each component in the preferred embodiment is symmetrical. That is, the connector housing 12, the termination cover 14, and the strain relief member 16 are symmetrical, whether they be divided length-wise or cross-wise.

As shown in FIG. 1, the connector housing 12 is comprised of an elongated member 18, which is molded of thermoplastic material, substantially in accordance with the teaching of U.S. Pat. No. 4,781,615. That patent is hereby incorporated by reference. Housing 12 has cable receiving face 20, opposed mating face 22 and a plurality of contact receiving passages 19 extending therebetween. The housing 12 has opposed parallel endwalls 24,26 with upstanding towers 28,30 flanking the cable receiving face 20 and a series of cable terminating contacts, such as 32, extending upwardly from cable receiving face 20 between the endwalls 24,26. The terminating contacts, such as 32, are comprised of individual insulation displacement plates, such as 33,34.

Figure 7:
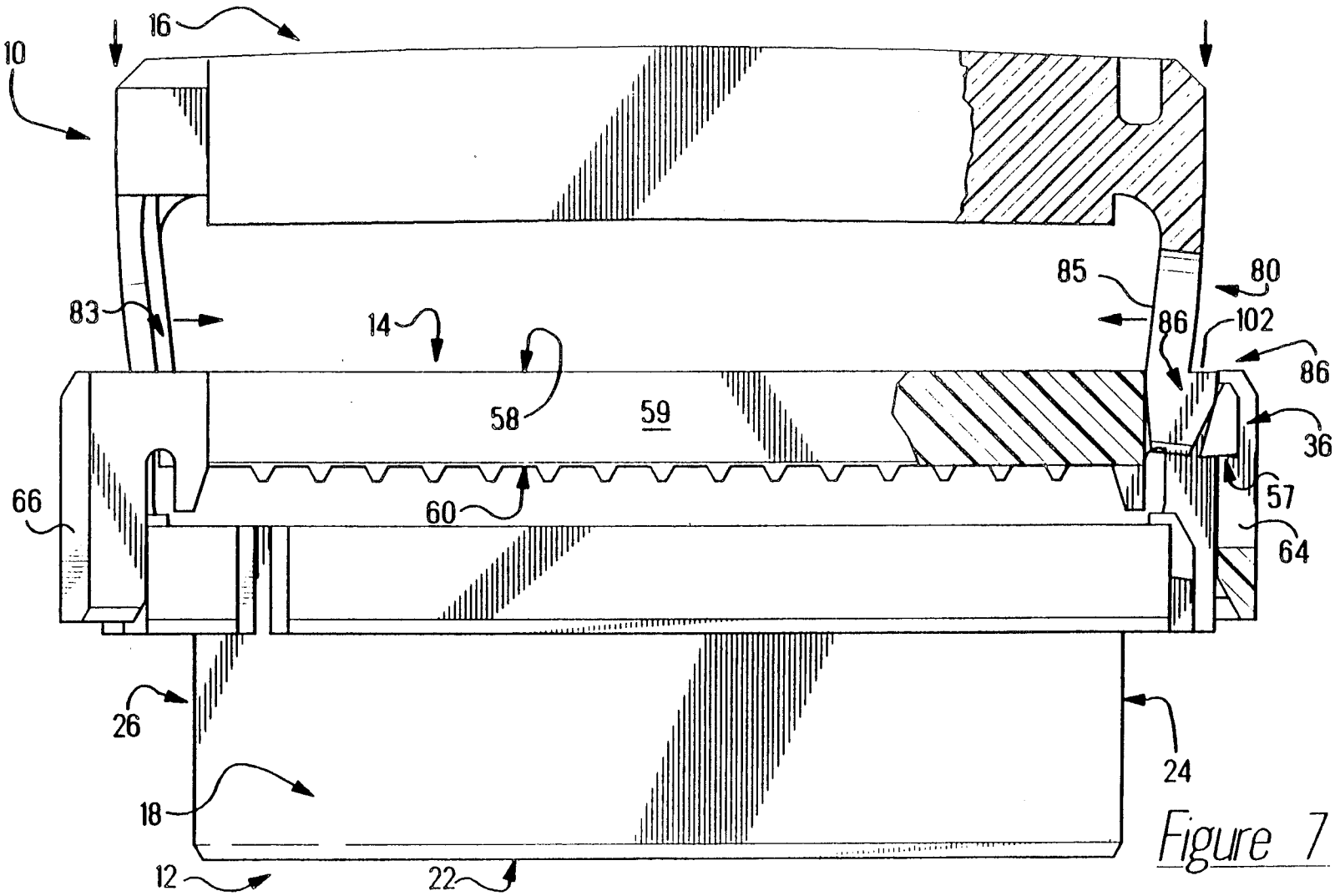
Figure 8:
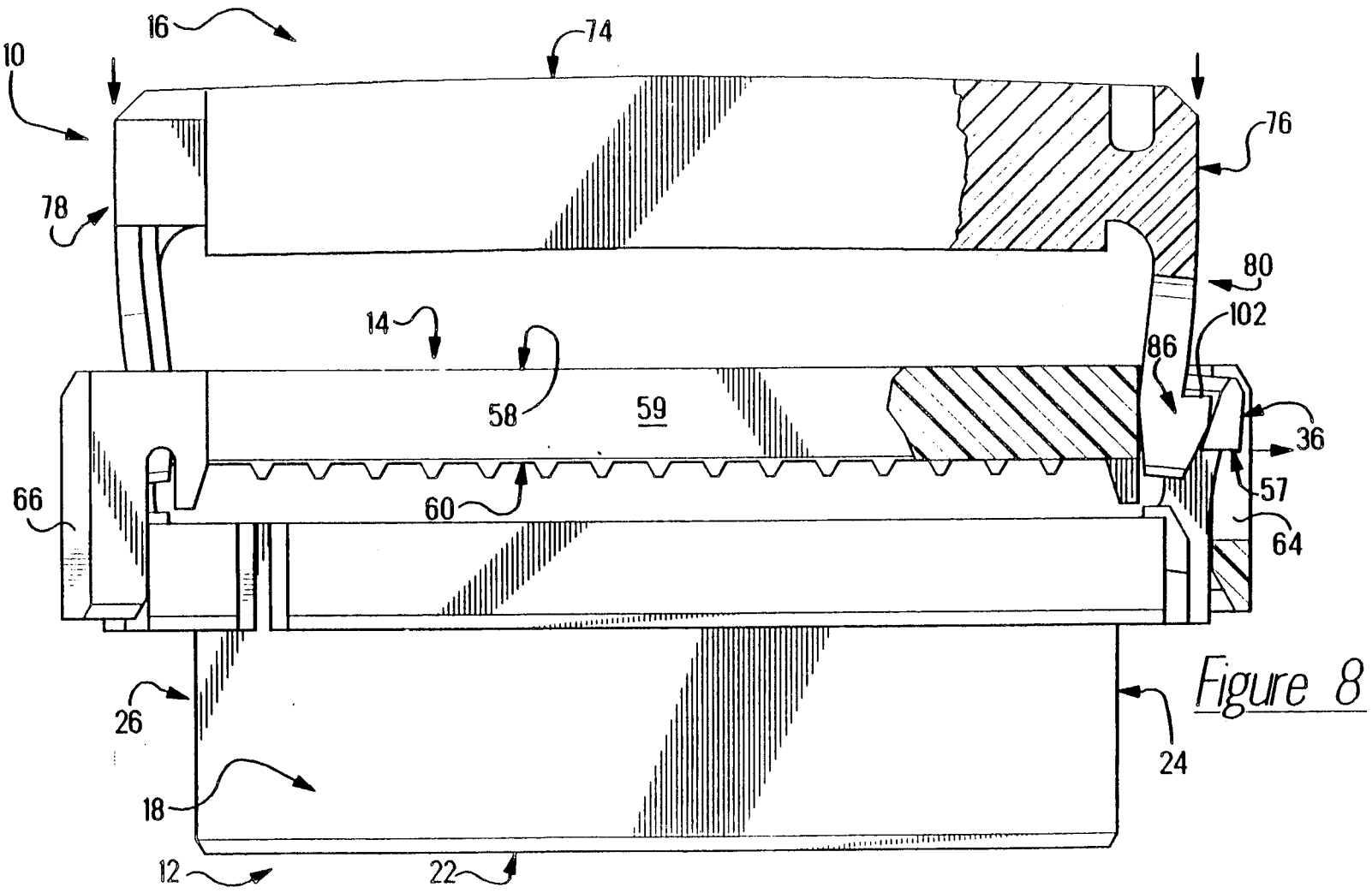
Figure 9:
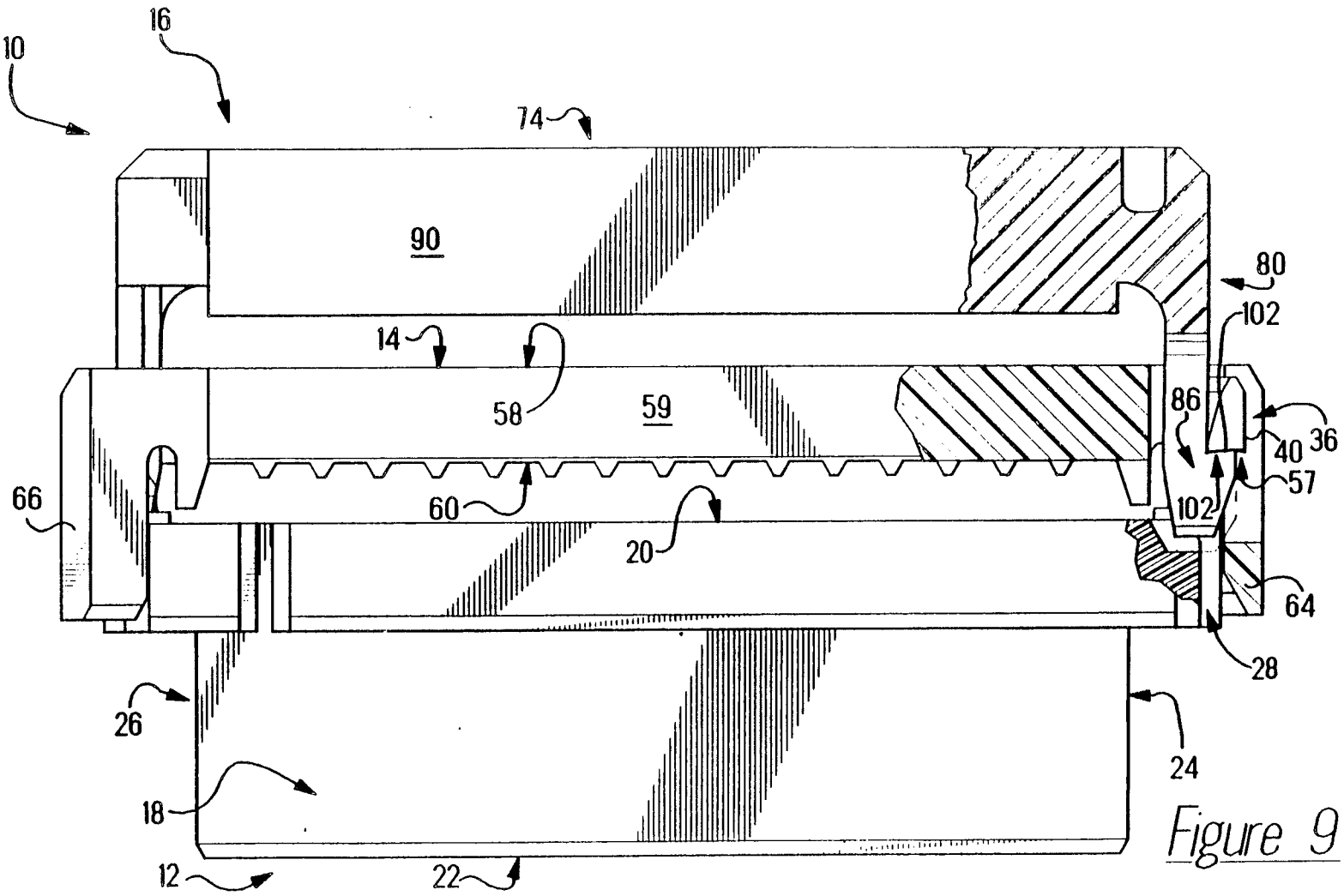

Extending outwardly and downwardly from each connector housing tower 28,30 of housing 12 are latching protrusions 36,38. Each latching protrusion 36,38 has two outer ramped latching surfaces (see 40,42,44,46) facing away from cable receiving face 20; two inner ramped surfaces (see 48,50,52,54); parallel, opposed side members, such as 55; a flat top surface, such as 56; and (as best shown in FIGS. 7-9) a flat "bottom" latching surface, such as 57.

Figure 5:
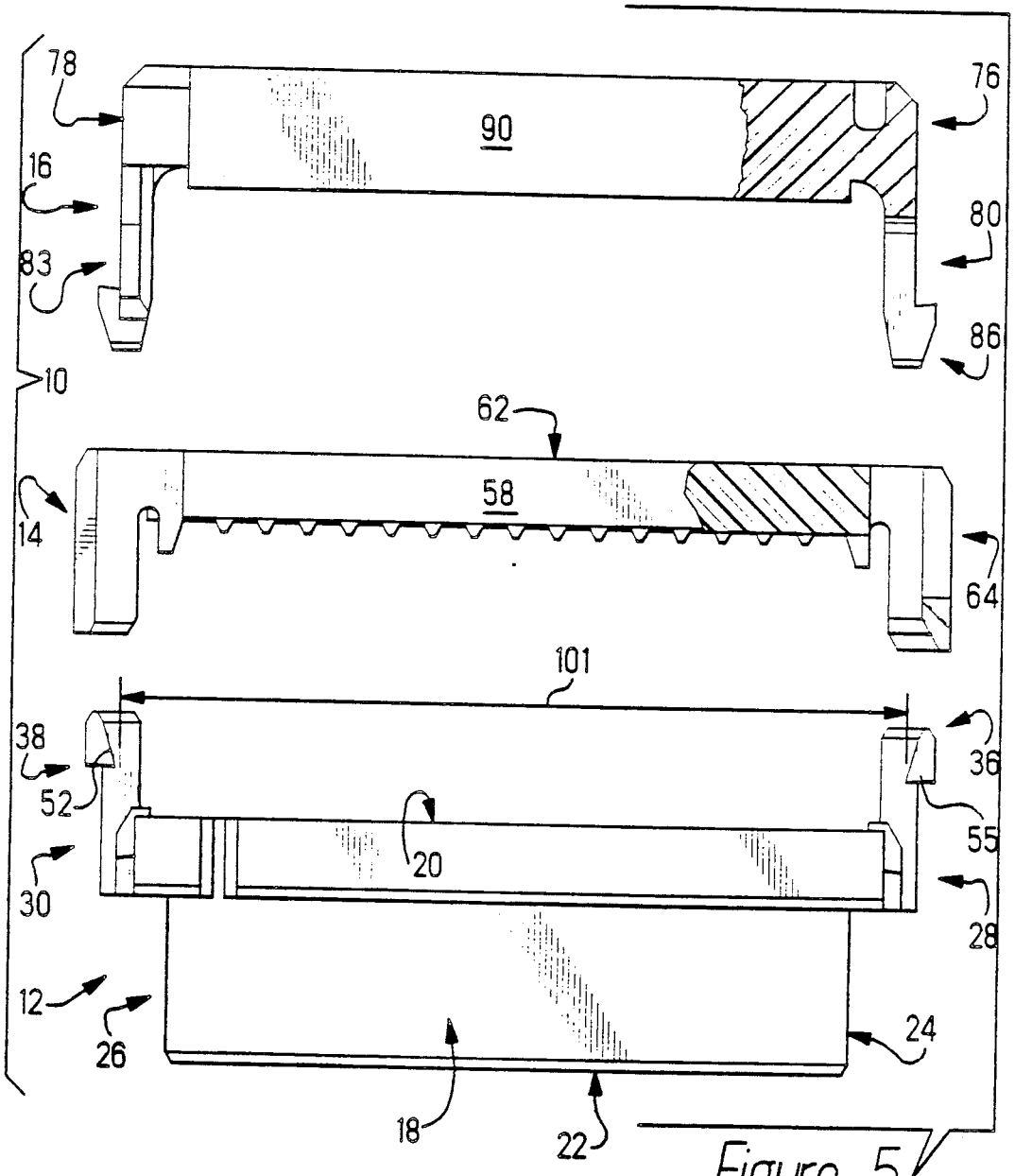
FIG. 5 is a side view of the connector housing, partially in cross section, with the termination cover and strain relief member positioned thereabove (connector housing contacts have been omitted for clarity)

Also shown in FIG. 1 is a termination cover 14. It is generally comprised of crossmember 58 which has a sidewall 59, an underneath fluted surface 60, and a smooth top surface 62. See also FIG. 5. The crossmember 58 is flanked on each end by U-shaped guide agents 64,66 with receiving slots (e.g. 67). The guide agents 64,66 extend outwardly from the crossmember 58, leaving recessed slot portions of sufficient size to receive the towers 28,30 of the connector housing 12 and the strain relief member 16.

Each U-shaped guide agent 64,66 of the termination cover 14 has a flat inner surface 68,70. Each inner surface 68,70 faces the other and is parallel thereto. Each guide agent 64,66 has a series of downwardly ramped edges, such as 72. Each flat inner surface 68,70 protrudes from behind its respective guide slot 64,66. For example, the flat inner surface 68 only extends far enough to form a L-shape. See FIG. 1.

Also, shown in FIG. 1 is a strain relief member 16. The strain relief member 16 is comprised of an elongated crossmember 74 which is flanked on both ends by opposed, parallel endwalls 76,78; and they are perpendicular to the crossmember 74. Each endwall 76,78 has a pair of latch arms 80,81 or 82,83. Further, the latch arms 80,81,82,83 have protruding members, such as 84,86.

Each latch arm is further comprised of a flat outer surface, such as 88, which is parallel to one of the side walls, such as 90. Each latch arm, such as 80, is also comprised of a downwardly and inwardly ramped side member, such as 92, which slopes toward the arm's protruding member (here, 86).

Each protruding member, such as 84, has a flat inner surface, such as 94. It extends to form a portion of the latch arm (see 82) and is parallel to both side walls (see 90). Each of the flat inner surfaces, such as 94, faces the other and is parallel thereto.

The outer portion of each protruding member, such as 86, is further comprised of a downwardly and inwardly sloping outer surface, such as 96; an endwall portion, such as 98; a ramped base, such as 100; a flat top portion or "upper" latching surface, such as 102; and two sidewall portions, such as 103.

The inside portion of each protruding member is comprised of segmented surfaces (see, e.g., 104, 106).

Figure 6:
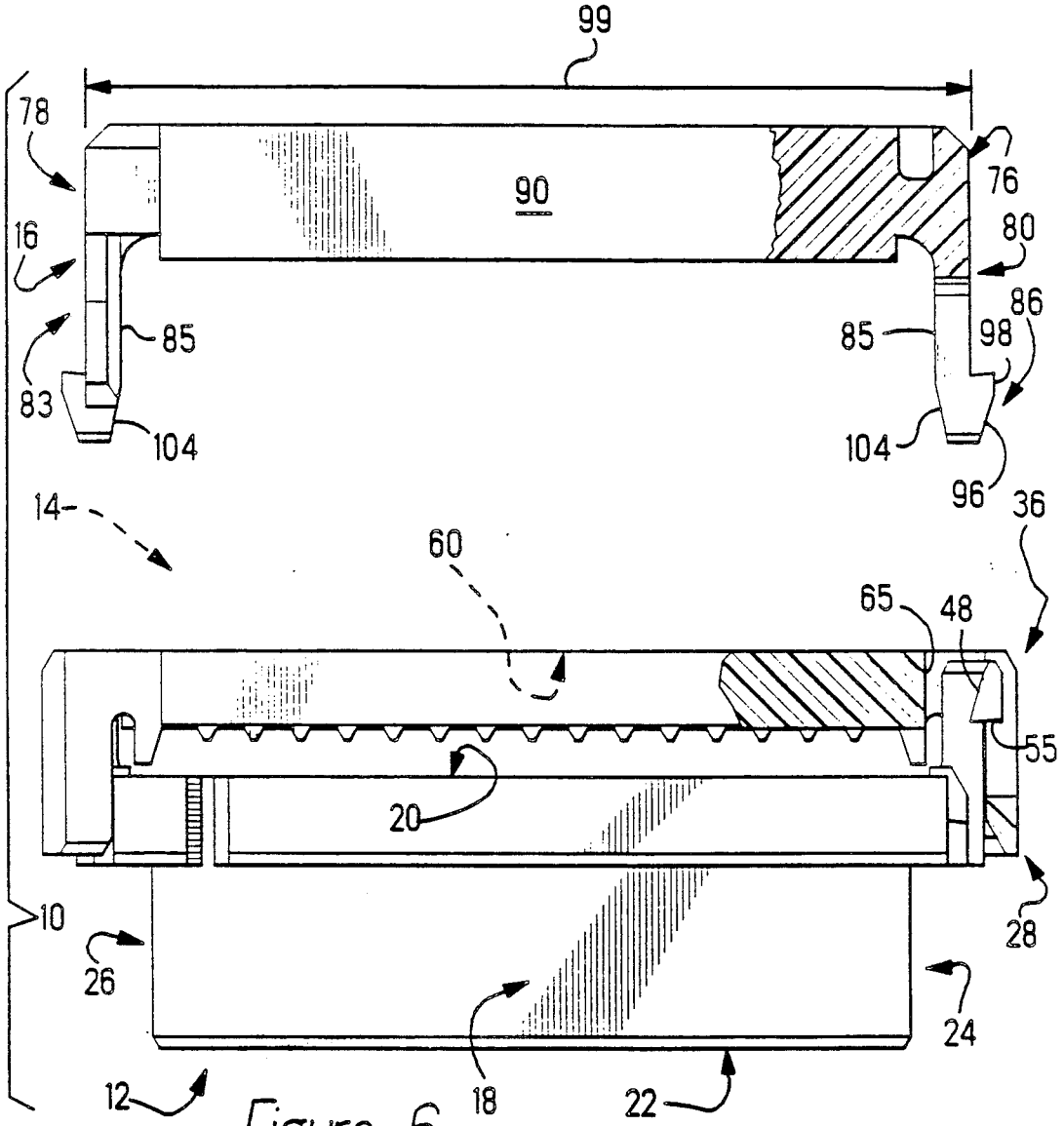
FIG. 6 is a side view similar to FIG. 5, with the termination cover shown in its cable terminated position.

In operation with the termination cover with the termination cover 14 secured to the connector housing 12 in a pretermination position, a cable 108 is inserted between the distal ends of the insulation displacement plate portions, such as 34, of the contacts, such as 32 and the fluted surface 62 of the termination cover. See FIG. 6. The termination cover 14 is then pressed toward the connector housing 12 to effect a termination of individual conductors of the cable 108 to respective ones of the contacts, such as 32. FIG. 6 shows the termination cover 14 secured to connector housing 12 in its cable terminated position with a cable (omitted for clarity) terminated thereto.

Figure 4:
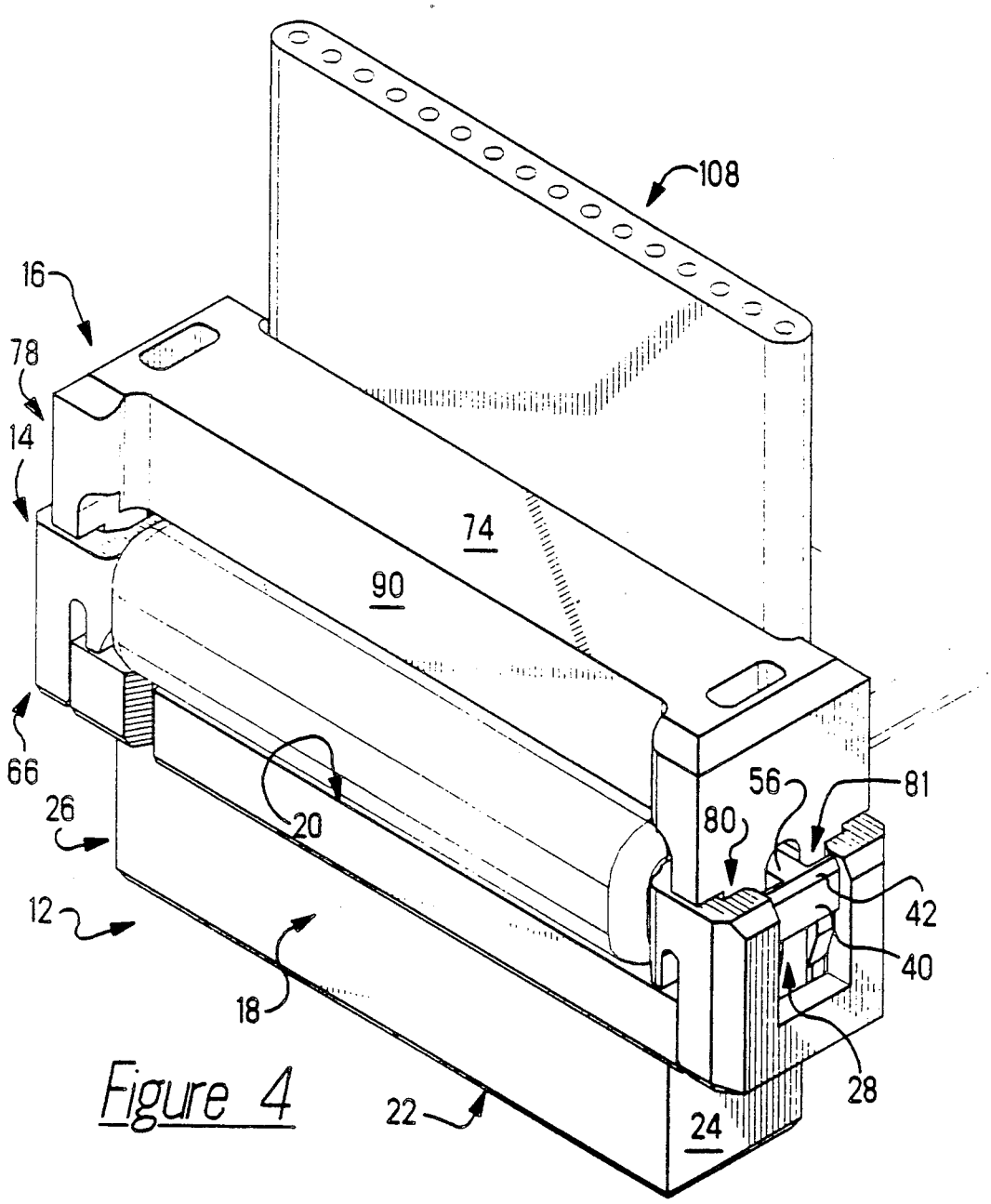
FIG. 4 is a perspective view of the assembled invention, showing a ribbon cable terminated thereto.

Cable 108 is then folded along a sidewall 59 thence over top 62 of termination cover 14 (see FIG. 4). Since the functioning of the strain relief member 16 is identical at both ends, portions of the description below will describe the operation at only one end.

Strain relief member 16 is positioned over cable 108 the subassembly of the termination cover 14 secured to the connector housing 12 in the cable terminated position as shown in FIG. 6. As strain relief member 16 is moved toward the termination cover, the distal ends of latch arms 80,81,82 and 83 are received in respective guide slots 67. Beveled surfaces 96 may engage inner surface 63 at top surface 62 or beveled surface 104 may engage inner surface 65 at top surface 62 to position strain relief member 16 lengthwise relative to connector housing 12 and termination cover 14.

Continued movement of strain relief member 16 will cause the latch arms to engage beveled surfaces 55, or beveled surface 92 to engage inner surfaces 69 at top surface 62 to position strain relief member 16 laterally relative to connector housing 12 and termination cover 14.

With strain relief member 16 properly positioned both length wise and laterally relative to connector housing 12 and termination cover 14, continued movement there toward causes the apex at the inner face between surfaces 96 and 98 to engage, react with and ride along respective inner ramped surface 48 as shown in FIG. 7. This occurs at four locations on the connector. This reaction initially causes the pair of latch arms 80 and 81 at one end to flex inwardly toward the other pair of latch arms 82 and 83 which are similarly flexed inwardly at the other end of strain relief member 16. Cross member 74 may even bow slightly as shown in FIG. 7. Simultaneously end wall 76 and 78 slide along inner surfaces 63 while surfaces 103 of protrusion members 84 and 86 slide along inner surface 71 of guide slot 67 to maintain strain relief member 16 orthogonal to the direction in which it is moving.

Continued movement of strain relief member 16 toward connector housing 12 and termination cover 14 causes inner surface 85 of latch arms 80 and 81 at one end of strain relief member 16 and latch arms 82 and 83 at the other end of strain relief member 16 to engage respective inner surfaces 65 of the termination cover. Further continued movement of strain relief member 16 toward connector housing 12 and termination cover 14 causes the apex at the interface of surfaces 96 and 98 to ride further along inner ramp surface 48 and simultaneously inner surface 85, at the interface with beveled surface 104, to ride along respective inner surfaces 65 with the result that each tower is caused to flex outwardly as shown in FIG. 8.

Surface 85 slides along inner surface 65 as movement of strain relief member 16 is continued toward connector housing 12 and termination cover 14 until latch surfaces 102 on the latch arms at each end pass beyond flat latching surface 57 on a respective tower at that end, where upon both the latch arms and the towers resile to complimentary positions such that latch surfaces 102 overlie latching surface 57 to secure strain relief member 16 to the connector housing. The latch arms and towers resile to complimentary positions which may not be an unbiased position. As the latch arms resile, surface 85 pulls away from inner surface 65. See FIG. 9.

In a preferred embodiment, when the latch arms and respective towers resile, they do not resile to an unbiased position but remain biased against each other at each end of assembly 10 as shown in FIG. 9. This biased condition is achieved by providing an interference fit between the latch arms and the inner most portion of inner ramp surface 48,50,52 or 54. The distance 99 between surfaces 76 and 78 with the arms in an unbiased position is slightly greater than the distance 101 between the inner most portions of inner ramped surfaces 48 and 52 on opposed towers, that is the apexes of opposed towers. The bias assures that the retention force between the latch arms on the strain relief member and the tower is achieved at the root of each latch surface. After strain relief member 16 is secured, cable 108 can exit rearwardly of the connector assembly 10 as shown in FIG. 4 in the final assembly, or at a right angle thereto as shown in phantom in FIG. 4.

In the preferred embodiment, the abutting latching surfaces (e.g., 102 and 57) on latch arms 80,81,82,83 and towers 28,30 have reverse angles to enhance latching.

Figure 3:
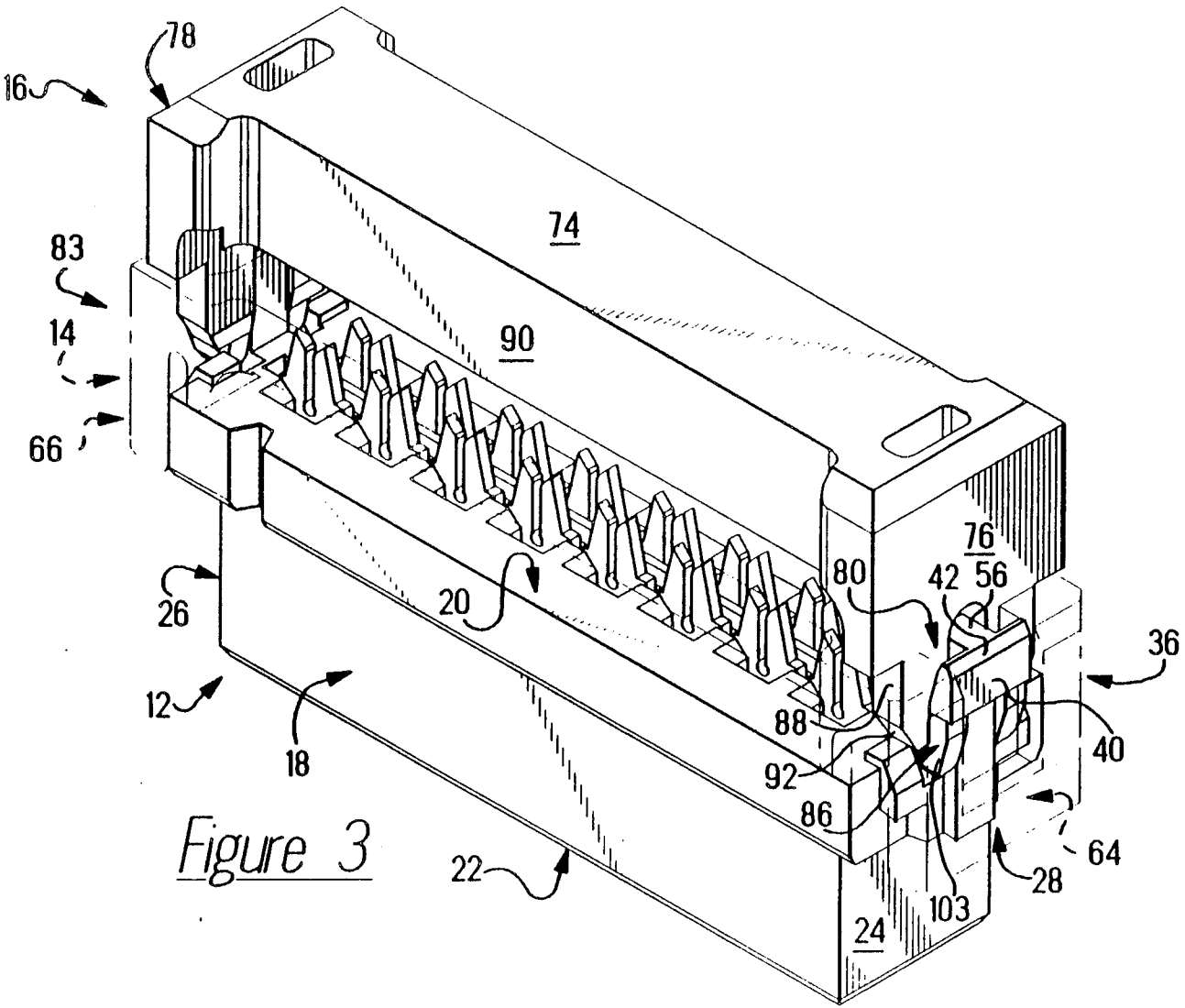
FIG. 3 is a perspective view of the strain relief member secured to the connector housing and termination cover, with the cover shown in phantom.

FIG. 3 likewise shows the invention 10 fully assembled, with the termination cover 14 shown in phantom.

In addition, the versatility of the strain relief member 16 should be noted. Should the strain relief member 16 become broken, and one latch arm, or one pair of latch arms fails, the strain relief member 16 will remain attached to the termination cover 14 and connector housing 12 and will provide a limited amount of strain relief.

It should be understood, by those skilled in the art, that obvious modifications can be made without departing from the spirit of the invention. Accordingly, reference should be made primarily to the accompanying claims, rather than the foregoing specification, to determine the scope of the invention.

I claim:

1. A strain relief for an electrical connector terminating a multi-conductor cable comprising:

a connector housing interconnected to a strain relief member with a termination cover fixed in between;

said connector housing having a cable receiving face, an opposed mating face, a series of contacts extending between said faces, opposed side walls, opposed endwalls, and a crossmember extending between said endwalls, said crossmember having a series of cable terminating contacts extending between said endwalls, said endwalls having integral upwardly extending towers, wherein each tower has an upwardly and outwardly extending latch protrusion with a bottom latching surface;

said termination cover having a top, an opposed bottom, opposed side walls, and opposed endwalls, said endwalls each having an outwardly and downwardly extending guide slots;

said strain relief member having a top, an opposed bottom, opposed side walls, and opposed endwalls, wherein each endwall has a pair of attached downwardly extending latch arms, wherein each latch arm has an outwardly and upwardly extending detent; and wherein each tower extends upwardly into a respective said guide slot, and a pair of said latch arms extend downwardly into each guide slot and around and under the respective latch protrusions of the towers so that the strain relief member is at all times within the profiles of the attached termination cover and connector housing.

2. The electrical connector assembly of claim 1 wherein the length of the strain relief member is greater than the spacing between the apex of the latch protrusions of the towers in an unbiased position.

3. The electrical connector assembly of claim 2 wherein each guide slot is longer than the combined width of a detent and tower, thereby allowing the latch arms and towers to flex during latching.

4. The electrical connector assembly of claim 1 wherein each detent has an upper latching surface that has a reverse angle to a respective bottom latching surface of a tower latch protrusion, whereby the latching surfaces of the detents and protrusions abut one another.

5. The electrical connector assembly of claim 1 wherein each tower further has a plurality of inner ramped surfaces, a plurality of outer ramped surfaces, and a flat top.

6. An electrical connector for terminating a multi-conductor cable comprising:

a connector housing having a cable receiving face, an opposed mating face, a series of cable contacts extending between said faces, opposed side walls, opposed endwalls, and a crossmember extending between said endwalls, said crossmember having a series of cable terminating contacts extending between said endwalls, said endwalls having integral upwardly extending towers, said towers having upwardly and outwardly extending latch protrusions, wherein each latch protrusion of each tower has a bottom latching surface;

a termination cover having a top, an opposed bottom, opposed side walls, and opposed endwalls, said endwalls each having an outwardly and downwardly extending guide slot; and a strain relief member having a top, opposed bottom, opposed side walls, and opposed endwalls, wherein each endwall has a pair of attached downwardly extending latch arms, wherein each latch arm has an outwardly and upwardly extending detent at a bottom portion of said latch arm, wherein each guide slot is adapted in size and shape to receive a respective pair of said latch arms, and wherein each detent has an upper latching surface that has a reverse angle to a respective bottom latching surface of a said tower latch protrusion, whereby the latching surfaces of the detents and protrusions abut one another when the connector is assembled.

7. The electrical connector of claim 6 wherein the length of the strain relief member is greater than the spacing between the apex of the latch protrusions of the towers in an unbiased position.

8. The electrical connector of claim 7 wherein each guide slot is longer than the combined width of a detent and tower, thereby allowing the latch arms and towers to flex during assembly.

9. The electrical connector of claim 6 wherein the attached strain relief member remains within the profiles of the connector housing and termination cover.

10. The electrical connector of claim 6 wherein each tower further has a plurality of inner ramped surfaces, a plurality of outer ramped surfaces, and a flat top.

11. An electrical connector for terminating a multiconductor cable comprising:

a connector housing means having a cable receiving face, an opposed mating face, a series of cable contacts extending between said faces, opposed side walls, opposed endwalls, and a crossmember extending between said endwalls, said crossmember having a series of cable terminating contacts extending between said endwalls, said endwalls having integral upwardly extending towers, said towers having upwardly and outwardly extending latch protrusions;

a termination cover means having a top, an opposed fluted bottom, opposed side walls, and opposed endwalls, said endwalls each having an outwardly and downwardly extending guide slots; and a strain relief member means having a top, an opposed bottom, opposed side walls, and opposed endwalls, wherein each endwall has a pair of attached downwardly extending latch arms, wherein each latch arm has a detent extending outwardly and upwardly from a bottom portion of said latch arm, wherein each guide slot is adapted in size and shape to receive a respective pair of said latch arms, and wherein the detents of the latch arms and the latching protrusions of the towers are adapted in size and shape to cooperate with one another and to be latched together to hold the strain relief member to the housing with the termination cover firmly attached between.

12. The electrical connector of claim 11 wherein the length of the strain relief member is greater than the spacing between the apex of the latch protrusions of the towers in an unbiased position.

13. The electrical connector of claim 12 wherein each guide slot is longer than the combined width of a detent and tower, thereby allowing the latch arms and towers to flex during latching.

14. The electrical connector of claim 11 wherein the attached strain relief member remains within the profiles of the connector housing and termination cover.

15. The electrical connector of claim 11 wherein each latch protrusion of each tower further has a plurality of inner ramped surfaces, a plurality of outer ramped surfaces, a top, and a bottom latching surface.

16. The electrical connector of claim 11 wherein each detent has an upper latching surface that has a reverse angle to a respective bottom latching surface of a tower latch protrusion, whereby the latching surfaces of the detents and protrusions abut one another when the connector is assembled.

* * * * *